US005341953A

United States Patent [19]

Forester

[11] Patent Number: 5,341,953

[45] Date of Patent: Aug. 30, 1994

[54] PARTITIONED CEREAL BOWL

[76] Inventor: Mary C. Forester, P.O. Box 89, Ghent, N.Y. 12075

[21] Appl. No.: 117,731

[22] Filed: Sep. 7, 1993

[51] Int. Cl.[5] ..... B65D 21/02

[52] U.S. Cl. ..... 220/575

[58] Field of Search ..... 220/575, 574.1

[56] References Cited

U.S. PATENT DOCUMENTS

| | | | |
|---|---|---|---|
| 759,696 | 5/1904 | Gordon | 220/555 |
| 766,427 | 8/1904 | Crowell | 220/575 |
| 876,808 | 1/1908 | Kinert | 220/575 |
| 1,520,402 | 12/1924 | Clemans | 220/575 X |
| 1,595,356 | 8/1926 | Moseman | 220/553 |
| 1,837,535 | 12/1931 | Duffey et al. | 220/553 |
| 2,170,311 | 8/1939 | Smith | 220/575 |
| 2,207,417 | 7/1940 | Smith | 220/575 |
| 2,843,287 | 7/1958 | Finley | 220/575 |
| 4,351,444 | 9/1982 | Majewski | 220/575 |
| 5,172,826 | 12/1992 | Celaya | 220/575 X |

*Primary Examiner*—Steven M. Pollard

*Attorney, Agent, or Firm*—Schmeiser, Morelle & Watts

[57] ABSTRACT

A partitioned cereal bowl with a region for dry cereal and another for liquid such as milk. A cereal bowl is provided, which precludes cereal from oversoaking, by partitioning it into a dry cereal-holding region and a liquid (milk)-holding region. The cereal-holding region is sloped in order to facilitate a sliding or scooping transfer of its contents over the partition and into the liquid-holding region. The base of the liquid-holding region is troughed in order to facilitate removal of all the liquid or cereal contained therein. Two embodiments exist to the invention, a first having a cereal region sloped base which descends to the partition from about the rim of the bowl and, an alternate version, in which the cereal region's sloped base ascends from near the bottom of the bowl to the crest of the partition. The basic concept of use is to maintain the dry cereal in set-apart fashion from the liquid contents until just prior to consumption when the consumer may moisten the cereal by scooping or sliding over a desired amount into the liquid.

2 Claims, 1 Drawing Sheet

PARTITIONED CEREAL BOWL

BACKGROUND OF THE INVENTION

1. Field of the Invention

This invention relates generally to dinnerware and, in particular, to bowl and basin type dinnerware used for segregated confinement of dry cereal from liquids, such as milk, that are used for moistening the cereal. The invention is noteworthy in that this type of cereal bowl has, as its predominant quality, the ability to maintain dry breakfast cereal in a fresh, crisp state until just before immersion in the moistening fluid so that subsequent portionwise consumption will not render remaining cereal portions soggy and unpalatable.

2. Disclosure of Relevant Art

A compartment plate or platter is disclosed in U.S. Pat. No. 1,595,356, issued on Aug. 10, 1926. The patent teaches a multi-compartmented tray, plate or platter, in which various foods, generally of a solid or amorphous nature, are placed into the separate compartments which serve to segregate the foods precedent to consumption. Within the array of sections or compartments, there is disclosed a solitary compartment, circular in shape, and shallower than the remaining compartments. Patent '356 describes this compartment only as a "a circular commodity receiving space". This space occupies less than 1/10 of the volume of the entire tray and, therefore, could not conceivably serve as a liquid reservoir when one considers that the average consumer of one ounce of dry cereal uses approximately ½ to 1 cup of liquid (generally milk). The use of the '356 tray in the manner to be disclosed hereinafter, is simply too tedious.

Yet another disclosure of a bowl device having therein an integral partition means, is U.S. Pat. No. 759,696, issued on May 10, 1904. Although disclosing primarily a wash hand basin, '696 teaches a deep basin segmented by a lower-than-the-rim partition means into two minor basins. The bottoms of the minor basins are arcuate in shape to facilitate a two-handed scooping motion from the outer sides (interior bowl rim) of the minor basin, down towards the arcuate bottoms and up along the partition until the user's hands join at the edges of the palms in a cupping motion. Thus, the teaching of '696 is of a symmetrically partitioned basin which facilitates the use of one's hands in cupping water from the basin and drawing it towards the user (seemingly, the user's face). The symmetrical design of this basin is not suitable for my purposes. First, it is not convenient to pass one of the minor basin's contents to the other minor basin. In the movement of dry contents (cereal) to the liquid, one would be relegated to transferring it up and over the partition, one spoonful at time. Also, '696 teaches a spout along one portion of the bowl rim coextensive the center line of the partition. The purpose of the spout is, of course, to facilitate emptying the basin. Such a device in my invention would be nonutilitarian and too costly to incorporate. Furthermore, I have designed means by which the user of my invention might readily "spoon up" the remaining liquid in the bowl without resorting to the need for lifting the bowl to his or her lips. Such a facility is extremely functional when one considers that my bowl would find great use in restaurants or in public eating places. Oftentimes, milk is allowed to remain and be discarded (in restaurants) simply because the consumer does not wish to consume the remaining contents of cereal and milk as is done in the privacy of one's own home.

An eviscerating and inspection pan disclosed in U.S. Pat. No. 1,837,535 comes the closest to a partitioned device having some of the nominal features that I have conceived of for my partitioned cereal bowl. The pan or tray of '535 comprises two sections, one for holding a fowl and the other, contiguous with the first, for receiving the entrails of the fowl as it is eviscerated. However, my requirements cannot reasonably be satisfied by such a device and conforming it to my needs would destroy its fitness for its designed purpose.

After an exhaustive study of current catalogues and department store wares, and an additional search in the United States Patent Office, I have concluded that a device such as my instant creation does not reasonably exist. Conformance of existing cereal bowls to my requirements could not reasonably be accomplished by the consumer and the use of existing art forms to accomplish my purpose of maintaining crisp cereal in an unmoistened mode just prior to consumption, likewise cannot be done.

SUMMARY OF THE INVENTION

I have accomplished the aforesaid purpose and overcome the limitations of prior art by designing and making a cereal bowl having several features distinctive over the bowls disclosed or now commonly used. Firstly, I have asymmetrically partitioned my bowl into two minor basins. One basin, intended to hold dry cereal, is larger than the other because, although the liquid (hereinafter milk) requirement is generally greater in weight, it is considerably less in volume. Secondly, although the milk portion (minor basin) is smaller in volume, it is deeper than the cereal portion. This follows because, as the cereal is moved over the partition and into the milk basin or reservoir, there is a need to stir these dissimilar substances in order to quickly moisten the cereal. The deeper basin facilitates this activity. Also, at the base of the milk basin, I have designed an arcuate bottom or trough. The arc of the trough is such that it will reasonably accept the radiused tip of a cereal spoon. It is this trough that allows one to "scoop" remaining contents of cereal and milk from the bowl so as to avoid the aforementioned waste. Lastly, (and) regressing to the cereal portion of the bowl, this minor basin is afforded a sloped base that rises from the outside edge of the bowl, rampwise, to the crest of the partition. An alternate embodiment has the ramped base descending from the side of the bowl, proximate the rim, toward the partition, where it then transitions through an arcuate fillet and rises immediately to the crest of the partition. The descending slope, in this embodiment, is continued into the adjacent, liquid minor basin, or recontacts the wall of the bowl in the same trough that was described in the earlier embodiment of my invention.

Outwardly, the base of the cereal bowl is generally of a dimension smaller than the rim, either circular or rectilinear, that would facilitate stacking the bowls.

DETAILED DESCRIPTION OF THE PREFERRED EMBODIMENT

Figure 1:
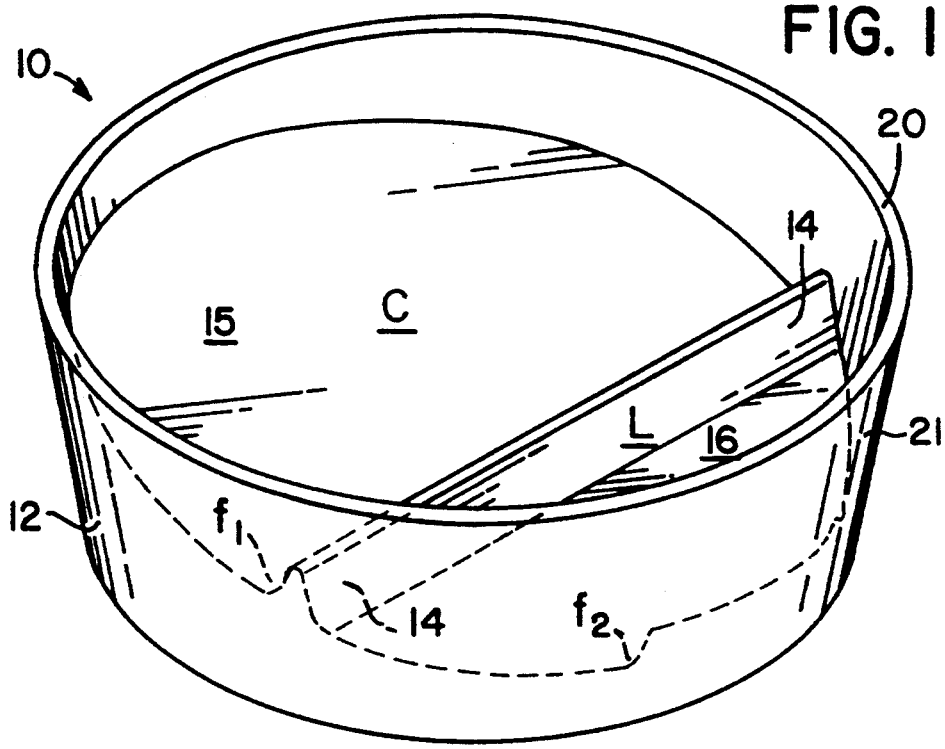
FIG. 1 is an isometric illustration of a sloped-base, partitioned bowl.

Referring to FIG. 1, there is an isometric illustration of the preferred embodiment of my partitioned cereal bowl 10. The bowl 12 proper may be of any easily manufactured shape, such as a circular or rectilinear form. A partition 14 divides the bowl 12 into two portions, called subbasins, one for cereal C and the other for milk or liquid L. In my preferred embodiment, the base 15 of the cereal minor basin C is sloped downwardly from proximate the rim 20 of the bowl to the partition 14. It intersects the partition in a filleted area $f_1$ as mentioned previously. The area $f_1$ is designed to accept the radiused tip of a cereal spoon (not shown). Continuing in the description relative to the liquid subbasin L, its base 16 is coplanar the C subbasin's sloped base 15. Likewise, it converges with the wall 21 of the bowl 12 in an arcuate region $f_2$. The second area is also arcuately designed for the same purposes as the first, that of receiving therein the radiused tip of a cereal spoon. In the case of region $f_1$, the area aids in the scooping or shuffling transfer of dry cereal contents over the partition 14 and into the liquid subbasin L. In the $f_2$ case, the trough grants ease to the final removal of liquid from its respective subbasin.

Figure 2:
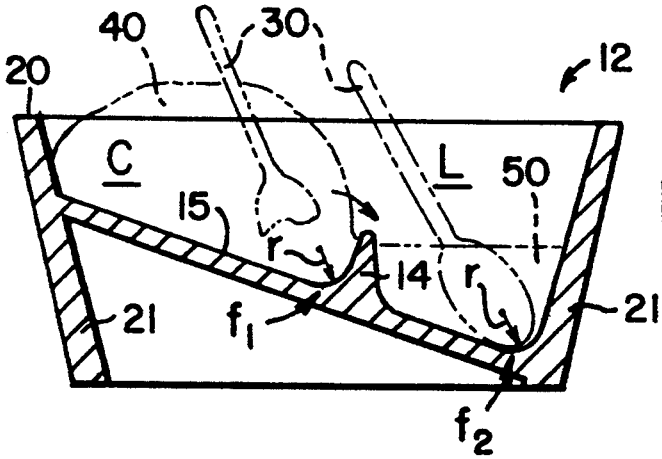
FIG. 2 is a sectional elevation of the FIG. 1 device.

FIG. 2, in cross section, clearly illustrates the features disclosed and described for FIG. 1. Therein, it may be clearly seen how spoon 30 is used to move cereal contents 40 into the liquid subbasin L, as shown by the boldfaced arrow. It may also be seen how regions $f_1$ and $f_2$ facilitate action of the spoon 30, as the radiused tip r moves through the respective regions. The liquid contents 50 are depicted for illustration purposes only.

Figure 3:
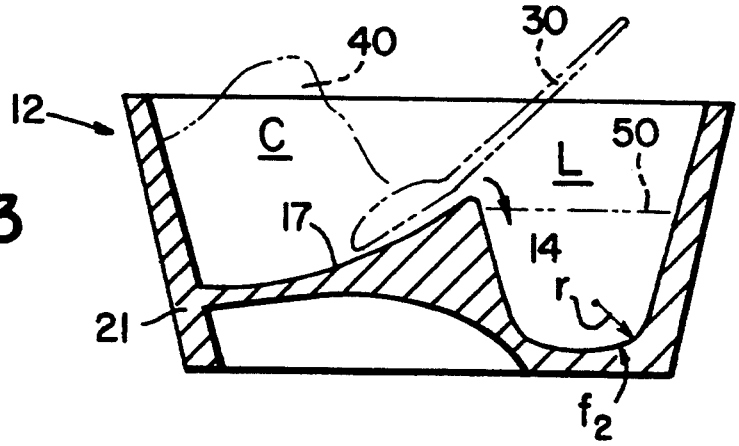
FIG. 3 is a sectional elevation of an alternate embodiment of the FIG. 1 device having a divergent sloped base divided by a single partition.

At FIG. 3, the reader sees an alternate embodiment depicted in cross section. Although the features of the liquid subbasin L remain the same, those of the cereal subbasin C take on the opposite perspective. The partition 14 remains the same, however, it is quite a bit thicker than in the preferred embodiment. Most noteworthy is that the base 17 of the cereal subbasin now ascends from the wall 21 of the bowl 12 and rises to the apex or crest of the partition 14. It is possible to yet incorporate a trough region $f_1$, but the practicality of such a design in this embodiment would appear wanting. In similar vein, those of ordinary skill would readily recognize that the liquid subbasin L could be completely arcuate and embody trough region $f_2$ at the center of the base (not shown).

Having disclosed my major concepts, I leave other minor improvements and modifications, such as would reasonably aid in obtaining the major benefit stated in my primary purpose for this invention, to manufacturers and users of the invention. I heartily commend such to them consistent with the hereinafter appended claims.

What is claimed is:

1. An open container for holding a dry, particulate breakfast cereal and a liquid in a set apart relationship so that a user may selectively moisten said cereal in said liquid during consumption, said container comprising in combination: a unitary, single bowl having an upper rim that is completely contained within a horizontal plane, that is separated into a first portion and a second portion by a chordwise-disposed, solid partition, having a generally triangular cross-section, so that said first portion comprises a first minor basin of greater depth than said second portion, having a bottom, said first portion featuring at the base thereof an arcuate circumferentially-disposed trough that is receptive of a radiused tip of a spoon instrument and said second portion comprising a second minor basin which features a sloped bottom that is at a higher elevation than the bottom of said first portion terminating at said partition and featuring means for facilitating cereal movement by said spoon instrument over said partition and into said first portion, said means comprising a side of said partition facing said second portion being upwardly sloping in the direction of said first portion.

2. The receptacle of claim 1 wherein said partition means is disposed chordwise with an upper margin thereof residing below the rim of the bowl.

* * * * *